US006639351B1

(12) United States Patent
Tsai et al.

(10) Patent No.: US 6,639,351 B1
(45) Date of Patent: Oct. 28, 2003

(54) PLANAR FLUORESCENT LAMP WITH FLAT ELECTRODES AND METHOD FOR FABRICATING

(75) Inventors: Kuang Lung Tsai, Hsinchu (TW); Yui Shin Fran, Hsinchu (TW); Chie-Ching Lin, Hsinchu (TW); Liang Kuei Sheu, Chia-I (TW)

(73) Assignee: Industrial Technologies Research Institute, Hsin Chu (TW)

( * ) Notice: Subject to any disclaimer, the term of this patent is extended or adjusted under 35 U.S.C. 154(b) by 0 days.

(21) Appl. No.: 09/273,023

(22) Filed: Mar. 19, 1999

(51) Int. Cl.[7] ..... H01J 17/16
(52) U.S. Cl. ..... 313/491; 313/493; 313/634
(58) Field of Search ..... 313/489–93, 573–74, 313/634–35, 631–32, 636–642, 264, 548–566; 315/169.1, 169.4, 169.3; 220/2.1 R

(56) References Cited

U.S. PATENT DOCUMENTS 5,319,282 A * 6/1994 Winsor ..... 331/493 X
5,461,279 A * 10/1995 Hasegawa ..... 313/493
5,479,069 A * 12/1995 Winsor ..... 313/493
5,717,284 A * 2/1998 Anandan et al. ..... 313/493 X
5,767,618 A * 6/1998 Maya et al. ..... 313/493
5,850,122 A * 12/1998 Winsor ..... 313/493
6,034,470 A * 3/2000 Vollkommer et al. ... 313/491 X
6,043,603 A * 3/2000 Weinhardt ..... 313/566
6,107,737 A * 8/2000 della Porta

* cited by examiner

*Primary Examiner*—Vip Patel
*Assistant Examiner*—Joseph Williams
(74) *Attorney, Agent, or Firm*—Tung & Associates

(57) ABSTRACT

A planar fluorescent lamp equipped with a pair of flat electrodes and a method for fabricating such lamp are disclosed. In the planar fluorescent lamp, a lamp housing and a cover plate which are both formed of a soda-lime glass can be bonded together to form a vacuum tight seal by glass frit. A pair of flat electrodes and a pair of getter strips are pre-mounted in the cavity of the planar lamp. The pair of flat electrodes run substantially the full width of the interior cavity of the lamp such that a substantially uniform electric discharge field can be formed in the cavity when a RF power is supplied to the electrodes. A bottom panel of the lamp housing may be fabricated in a ribbed structure to improve the rigidity of the bottom panel such that it does not bow in when the cavity is sealed under a vacuum pressure.

22 Claims, 4 Drawing Sheets

PLANAR FLUORESCENT LAMP WITH FLAT ELECTRODES AND METHOD FOR FABRICATING

FIELD OF THE INVENTION

The present invention generally relates to a planar fluorescent lamp that is equipped with flat electrodes and a method for fabricating the lamp and more particularly, relates to a planar fluorescent lamp that is equipped with flat electrodes situated in a cavity formed by a lamp housing and a cover plate capable of forming a substantially uniform electric discharge field in the cavity and a method for fabricating the lamp.

BACKGROUND OF THE INVENTION

In designing planar fluorescent lamps for illumination, it is desirable that the lamp designed is capable of providing uniform light distribution. A flat, planar fluorescent lamp can be advantageously used in various applications which include a light source for a back lit panel display, e.g., an advertising display or a liquid crystal display for electronic devices, or as any other light source for illumination. Ideally, a flat planar fluorescent lamp should produce uniform light and high brightness, should be compact in size and should require a low starting voltage such that only minimum accessaries such as transformers or ballasters are required.

Conventionally, backlighting technology for flat panel displays utilizes cathode fluorescent lamps for illumination. Even though the cathode fluorescent lamps provide high luminous efficiency and long service life, the lamps are normally installed in pairs along the sides of a display panel and thus do not produce a uniform lighting across the panel. This type of lighting arrangement has been used in the early laptop computers which does not produce satisfactory results in the illumination of a computer screen. Others have attempted to make improvements in backlighting by including a flat fluorescent backlight and a wedge-shaped light tube with the intent of distributing the light from a single bulb evenly over the entire display surface. This lighting arrangement, even though improves the light uniformity across the display panel, does not produce the brightness that is normally required in flat panel displays.

Still others have attempted to use flat fluorescent lamps in the illumination of display panels. One of such attempt is shown in U.S. Pat. No. 5,536,999, in which a flat fluorescent lamp is constructed by using a formed plate and a flat plate laminated together containing serpentine-shaped channel of between 4 and 7 chambers equipped with electrodes installed at the extreme ends of the sub-chambers. This is shown in FIGS. 1, 1A and 1B. In the typical design of a flat fluorescent lamp, a phosphor coating is placed on both a top and a bottom plate, which a reflective coating is only placed on the bottom plate. A high voltage between 1 kV and 3 kV which is determined by the panel size and the cathode type is normally required for starting such a flat fluorescent lamp.

As shown in FIG. 1, a conventional planar fluorescent lamp 10 is designed with a lamp body 12 which has two sidewalls 14 and two end walls 16 forming a rectangular shaped chamber. The sidewalls 14 and the end walls 16 are connected to base 18 (shown in FIG. 1A) to form chamber cavity 20. A transparent cover 22 overlays the lamp body 12 and joins the upper edges of the sidewalls 14 and end walls 16 to seal the chamber cavity 20. Chamber walls 24 extend between the cover 22 and the base 18 and project from one end wall 16 toward an opposite end wall 16 ending at a short distance from the opposite end wall 16 and leaving a gap thereinbetween. As shown in FIG. 1, the sidewalls 14, end walls 16 and the chamber walls 24 form a serpentine-shaped channel 26 extending from a first electrode 28 to a second electrode 30.

Barrier walls 32, 34 are positioned in the serpentine channel 26 near the electrodes 28, 30 and project upwardly from the base 18 toward the cover 22, ending at a short distance from the cover 22 and leaving an opening thereinbetween. The barrier walls 32, 34 are formed integrally with the lamp body 12 and extend laterally between one of the sidewalls 14 and its adjacent channel wall 24, parallel to the end walls 16. The barrier walls 32, 34 form a lateral insulative barrier in a lower portion of the serpentine channel 26.

The serpentine channel 26 defined by the insulative sidewalls 14 and end walls 16 provides a path for the electrical discharge which flows between the two electrodes 28, 30. FIG. 1A is a cross-sectional view of FIG. 1 taken along lines 2—2, while FIG. 1B is a cross-sectional view of FIG. 1A taken along lines 3—3.

In the flat fluorescent lamp design shown in FIG. 1, while capable of providing more uniform light than those other conventional flat fluorescent lamps, the sharp corners at the end of each of the serpentine channel 26 requires a 180° turn of the discharge path each time when the electrical discharge meets an end wall 16. The 180° turn contributes to a higher starting voltage required for the flat fluorescent lamp. The higher starting voltage in turn therefore requires a larger capacity transformer and ballasters which increase the size and weight of the fluorescent lamp fixture.

The serpentine-shaped channel 26 which extends from a first electrode 28 to a second electrode 30, when used as a discharge channel, provides an increased discharge length between the two electrodes 28, 30. However, the construction of a serpentine channel, as shown in FIGS. 1 and 1A is complicated and requires a complicated fabrication process. It is inevitable that a higher manufacturing cost is involved in making the fluorescent lamp with serpentine light channel. In an alternate construction, a flat panel fluorescent lamp 40, as shown in FIGS. 2 and 2A can be fabricated at lower manufacturing costs. In such a conventional flat panel fluorescent lamp 40, electrodes 36, 38 are used which are placed adjacent to the opposite sidewalls 42, 44, respectively. The electrodes 36, 38 are normally positioned to provide a somewhat uniform, centralized electric discharge field in the cavity 46 of the lamp fixture 40. A cross-sectional view taken along line 4—4 of FIG. 2 is shown in FIG. 2A.

In the conventional fluorescent lamp fixture 40, a reflective layer 48 is used to coat the outside of the lamp body 50. The reflective layer 48 helps to spread the light produced within the cavity 46 as an electric discharge occurs between the electrodes 36, 38. However, in this conventional flat panel fluorescent lamp fixture 40, since the electrodes 36, 38 are arranged toward the center of the lamp body 50, the uniformity of the electric discharge and the resulting light produced in the cavity is not uniform across the entire surface area of the lamp body 50. This occurs even though an uniform fluorescent coating material 52 has been applied to the interior surfaces of both the upper plate 54 and the lower plate 56.

It is therefore an object of the present invention to provide a planar fluorescent lamp that is equipped with flat electrodes which does not have the drawbacks or shortcomings of the conventional flat panel fluorescent lamps.

It is another object of the present invention to provide a planar fluorescent lamp that is equipped with flat electrodes by bonding a lamp housing and a cover plate formed of glass together with a glass frit forming a cavity therein for positioning the flat electrodes.

It is a further object of the present invention to provide a planar fluorescent lamp that is equipped with flat electrodes wherein the electrodes are formed in an elongated rectangular shape and positioned in a vacuum tight cavity juxtaposed to opposing side panels of the lamp body.

It is another further object of the present invention to provide a planar fluorescent lamp that is equipped with flat electrodes which further includes a pair of mercury dispensers positioned in the vacuum tight cavity each being placed adjacent to one of the flat electrodes.

It is still another object of the present invention to provide a planar fluorescent lamp that is equipped with flat electrodes which includes a pair of getter strips formed of metal and coated with $Hg_xTi_y$ for supplying mercury vapor in the cavity of the lamp.

It is yet another object of the present invention to provide a planar fluorescent lamp that is equipped with flat electrodes which includes a pair of getter strips formed of nickel and coated with a film of Al—Zn alloy on one side and $Hg_xTi_y$ on an opposite side.

It is still another further object of the present invention to provide a method for fabricating a planar fluorescent lamp that is equipped with a pair of flat electrodes by bonding a lamp housing to a cover plate with glass frit with a pair of flat electrodes and a pair of getter strips positioned in the vacuum tight cavity formed by the housing and the cover plate.

It is yet another further object of the present invention to provide a method for fabricating a planar fluorescent lamp that is equipped with a pair of flat electrodes which further includes the step of providing a lamp housing that has a top surface of a planar bottom panel fabricated in a ribbed structure.

SUMMARY OF THE INVENTION

In accordance with the present invention, a planar fluorescent lamp that is equipped with a pair of flat electrodes and a method for fabricating such lamp are provided.

In a preferred embodiment, a planar fluorescent lamp that is equipped with a pair of flat electrodes is provided wich includes a lamp housing that has a planar bottom panel and integrally formed side panels extending upwardly away from and along a peripheral edge of the planar bottom panel, the side panels have a height that is substantially similar to a thickness of the planar fluorescent lamp, a cover plate that has planar top and bottom surfaces each having a surface area that is the same as the planar surface area of the bottom panel, the bottom surface of the cover plate sealingly engaging the side panels on the lamp housing to form a vacuum tight cavity therein, a fluorescent coating layer on a top surface of the planar bottom panel and a bottom surface of the cover plate, and a pair of flat electrodes each formed in an elongated rectangular shape and positioned in the vacuum tight cavity with each juxtaposed to one of two opposing side panels for forming a substantially uniform electric discharge field in the cavity.

The planar fluorescent lamp may further include a pair of mercury dispensers each positioned adjacent to one of the flat electrodes. The lamp may further include a pair of mercury dispensers in an elongated strip which has $Hg_xTi_y$ coated thereon positioned in the vacuum tight cavity juxtaposed to the pair of flat electrodes. The lamp may further include heating means for maintaining the pair of mercury dispensers at a temperature higher than ambient. The lamp housing and the cover plate may be formed of a ceramic material, or formed of glass. The bottom surface of the cover plate sealingly engages the side panels on the lamp housing by bonding with a glass frit. The top surface of the planar bottom panel may be fabricated with a corrugated structure, or with a ribbed structure. The ribbed structure on the planar bottom panel may include a plurality of ribs each having a rib-to-rib distance between about 1 mm and about 10 mm, and a height of not more than 0.7 mm.

In the planar fluorescent lamp, the fluorescent coating layer formed on the top surface of the planar bottom panel and the bottom surface of the cover plate may include phosphor. The pair of mercury dispensers may be formed on a pair of getter pieces that are made of a metallic material, or made of nickel. The getter pieces may be formed of nickel that has a film of Al—Zn alloy coated on one side and a film of $Hg_xTi_y$ coated on an opposite side.

The present invention is further directed to a method for fabricating a planar fluorescent lamp that is equipped with a pair of flat electrodes by the operating steps of first providing a lamp housing which has a planar bottom panel and integrally formed side panels extending upwardly away from and along a peripheral edge of the planar bottom panel, the side panels may have a height that is substantially similar to a thickness of the planar fluorescent lamp, providing a cover plate which has planar top and bottom surfaces each having a surface area substantially the same as the planar surface area of the bottom panel, coating a fluorescent layer on a top surface of the planar bottom panel and the bottom surface of the cover plate, positioning a pair of flat electrodes each formed in an elongated rectangular shape in the lamp housing with each juxtaposed to one of two opposing side panels, and sealingly engaging the bottom surface of the cover plate with the side panels on the lamp housing to form a substantially vacuum tight cavity thereinbetween.

The method for fabricating a planar fluorescent lamp may further include the step of providing a pair of mercury dispensers in the substantially vacuum tight cavity and positioning each of the pair between one of the flat electrodes and one of the side panels. The method may further include the step of providing a pair of getter strips each formed of a metallic material and coated with a film of Al—Zn alloy on one side and a film of $Hg_xTi_y$ on an opposite side. The method may further include the step of heating the pair of getter strips by a heating means to a temperature higher than 300° C.

The method for fabricating a planar fluorescent lamp may further include the step of forming the lamp housing and the cover plate in glass, and sealingly engaging the bottom surface of the cover plate with the side panels by bonding with a glass frit. The method may further include the step of providing a lamp housing that has a top surface of the planar bottom panel in a corrugated structure, or in a ribbed structure. The method may further include the step of coating the top surface of the planar bottom panel and the bottom surface of the cover plate with a coating material that includes phosphor.

In an alternate embodiment, a planar fluorescent lamp that is equipped with flat electrode for illuminating liquid crystal display panels can be provided which includes a lamp housing that has a bottom panel and integrally formed side panels extending upwardly away from and along a periphery of the bottom panel, the side panels may have a height of not more than 5 mm, a plurality of rib sections formed in a top surface of the bottom panel sufficient to maintain a flatness of the bottom panel when the panel is under a vacuum pressure, a cover plate which has parallel top and bottom surfaces and a surface area similar to a surface area of the bottom panel, the bottom surface of the cover plate sealingly engaging the side panels on the lamp housing to form a vacuum tight cavity therein, a phosphor coating on a top surface of the planar bottom panel and the bottom surface of the cover plate, a pair of flat electrodes each formed in an elongated rectangular shape and positioned in the cavity with each juxtaposed to one of two opposing side panels for forming a substantially uniform electric discharge field in the cavity, and a pair of getter strips each positioned between a flat electrode and an adjacent side panel for providing a mercury vapor in the cavity.

In the planar fluorescent lamp equipped with a pair of flat electrodes for illuminating liquid crystal display panels, the pair of getter strips may be formed of nickel and coated with Al—Zn on one side and $Hg_xTi_y$ on an opposite side.

BRIEF DESCRIPTION OF THE DRAWINGS

These and other objects, features and advantages of the present invention will become apparent from the following detailed description and the appended drawings in which.

DETAILED DESCRIPTION OF THE PREFERRED AND ALTERNATE EMBODIMENTS

Figure 1:
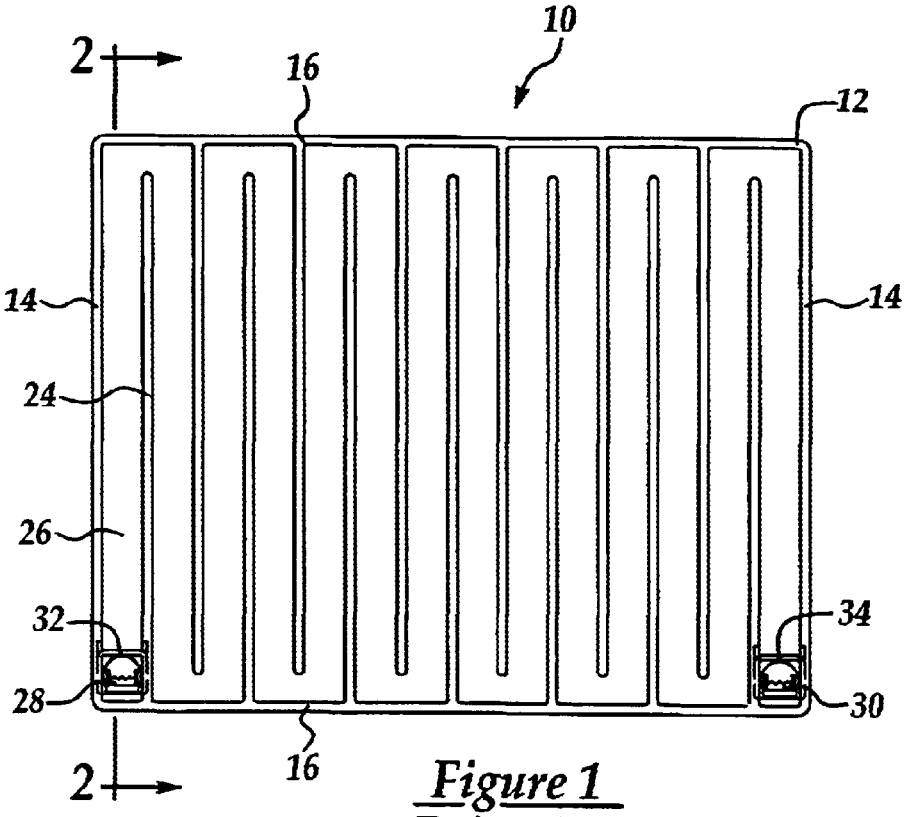
Figure 1 Prior Art
FIG. 1 is a plane view of a conventional flat fluorescent lamp fixture that utilizes serpentine-shaped light channels.
Figure 1A:
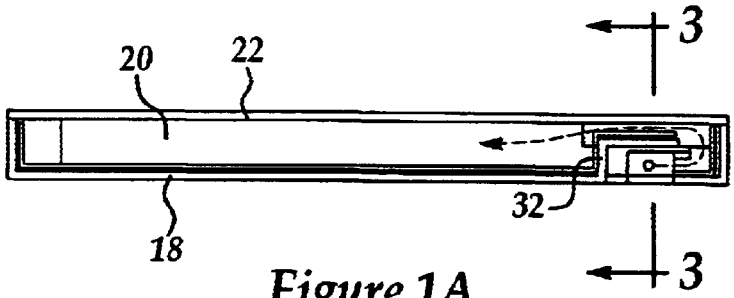
Figure 1A Prior Art
FIG. 1A is a cross-sectional view taken along line 2—2 of FIG. 1.
Figure 1B:
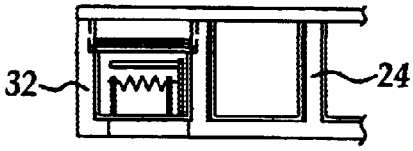
Figure 1B Prior Art
FIG. 1B is an enlarged, partial, cross-sectional view of the flat panel fluorescent lamp fixture of FIG. 1 showing the electrode.
Figure 2:
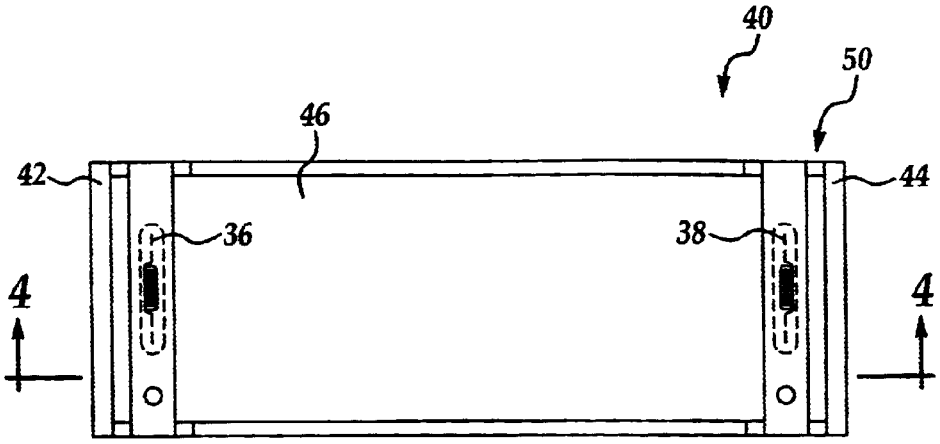
Figure 2 Prior Art
FIG. 2 is a plane view of a conventional flat panel fluorescent lamp fixture that utilizes a pair of electrodes that are positioned near the center of the opposing side panels.
Figure 2A:
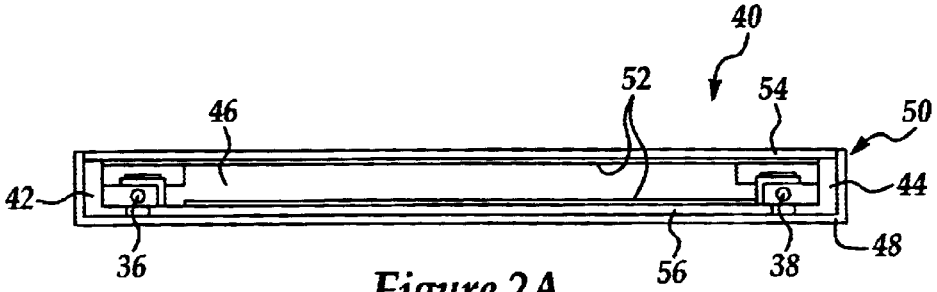
Figure 2A Prior Art
FIG. 2A is a cross-sectional view taken along line 4—4 in FIG. 2 illustrating the position of the electrodes.

The present invention discloses a planar fluorescent lamp that is equipped with a pair of flat electrodes which have an elongated rectangular shape positioned along two opposing side frames of the lamp housing in a spaced-apart relationship such that a substantially uniform electric discharge field can be achieved in the lamp cavity. The planar fluorescent lamp may further include. a pair of getter strips which are arranged in the two opposite ends of the lamp housing with each adjacent to one of the flat electrodes. The getter strips may be formed of a metallic material such as nickel and coated with an aluminum-zinc alloy film on one side and a mercury containing chemical compound on the opposite side. The lamp may further include heating means for keeping the getter strips at a temperature higher than ambient temperature such that mercury vapor can be readily formed from the mercury containing chemical compound coated on the getter strip.

In an alternate embodiment, the bottom panel of the lamp housing may be provided in a corrugated structure, or in a ribbed structure to improve the rigidity of the lamp housing. The improved rigidity is important in that when the lamp cavity is subjected to a vacuum pressure during the lamp fabrication process, the bottom panel of the lamp housing does not bow in and thus changing the volume and shape of the cavity maintained between the bottom panel and the cover plate. A suitable height of the rib sections may be 0.5 mm, while a suitable distance between two adjacent rib sections may be between about 1 mm and about 10 mm, and preferably about 5 mm.

The present invention further discloses a method for fabricating a planar fluorescent lamp that is equipped with a pair of flat electrodes which can be carried out by bonding a lamp housing and a cover plate both formed of a glass material with a glass frit forming a cavity therein. A pair of flat electrodes and a pair of getter pieces are positioned in the lamp housing before the bonding process. One of the pair of electrodes and one of the pair of getter pieces are positioned at each end of the lamp housing in the cavity such that a substantially uniform electric discharge field can be formed inside the cavity to improve the brightness and uniformity of light produced by the planar fluorescent lamp.

The present invention method of forming a planar fluorescent lamp is shown in FIGS. 3A~3D. In the method, a lamp housing 60 which is constructed by a planar bottom panel 62 and integrally formed side panels 64 extending upwardly away from and along a peripheral edge of the planar bottom panel 62. The side panel 64 has a height that is substantially similar to a thickness of the planar fluorescent lamp desired. The lamp housing 60 can be formed of a ceramic material such as glass. A suitable glass to be used can be a soda-lime glass such as one supplied by Corning® 0080 or 7059. A suitable size for the lamp housing, or a suitable size of the planar fluorescent lamp to be formed is about 50 mm×40 mm×3.5 mm thick. When the soda-lime glass of Corning® 0080 is used, a glass frit 7575 (also supplied by Corning®) can be used to bond the lamp housing 60 to a cover plate 70 (shown in FIG. 3D). When a hard glass of Corning® 7059 is used in the lamp housing 60, a glass frit 1301 (also supplied by Corning®) can be used for bonding.

Figure 3A:
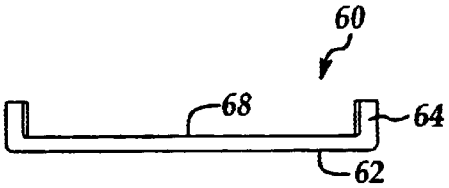
FIG. 3A is a cross-sectional view of a lamp housing used in the present invention flat panel fluorescent lamp.
Figure 3B:
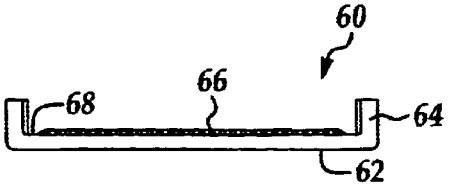
FIG. 3B is a cross-sectional view of the present invention lamp housing of FIG. 3A coated with a fluorescent coating layer.
Figure 3C:
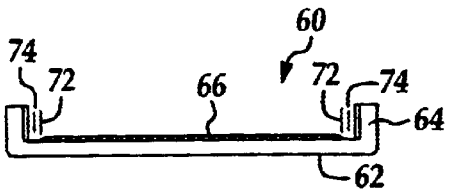
FIG. 3C is a cross-sectional view of the present invention lamp housing of FIG. 3B having a pair of flat electrodes and a pair of getter strips installed therein.
Figure 3D:
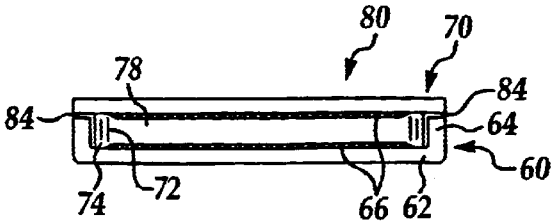
FIG. 3D is a cross-sectional view of the present invention lamp housing of FIG. 3C having a cover plate bonded to the side panels of the lamp housing.
Figure 4:
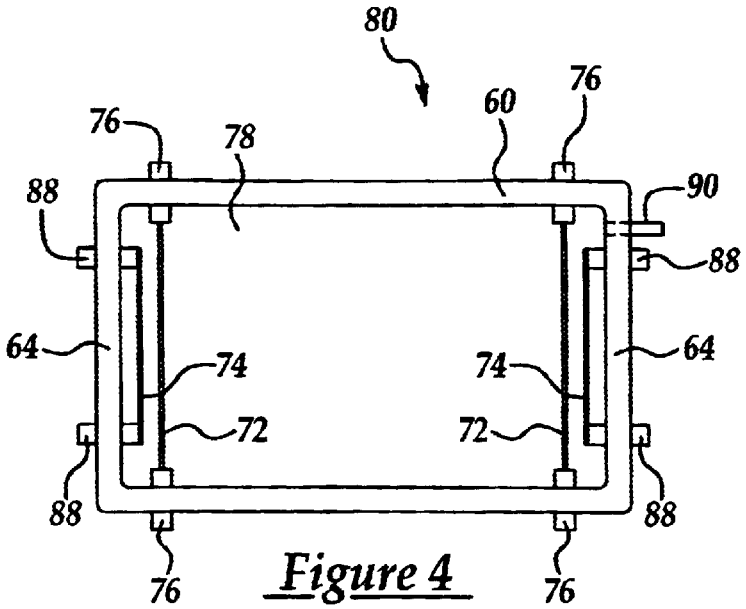
FIG. 4 is a plane view of the present invention planar fluorescent lamp with the pair of electrodes and pair of getter strips installed therein.

In the next step of the process, shown in FIG. 3B, a fluorescent coating layer 66 is applied to the top surface 68 of the planar bottom panel 62. The fluorescent coating layer 66 can be any suitable fluorescent material. A frequently used material is one that contains substantially of phosphor, or a tri-wavelength phosphor. After the top surface 68 is coated with the coating layer 66, a pair of flat electrodes 72 and a pair of getter strips 74 are mounted and positioned in the lamp housing 60. The pair of flat electrodes 72 are also shown in FIG. 4 in a plane view of the present invention planar lamp 80. It is seen in FIG. 4 that the pair of electrodes are formed of substantially elongated rectangular shape which are fastened at each end by mounting support 76. The length of the electrodes 72 is substantially the same as the interior width of the lamp housing 60. The pair of electrodes 72 are positioned such that the plane of the electrode is perpendicular to the longitudinal plane of the lamp 80. For instance, when the lamp 80 has a width of 40 mm, the length of the flat electrode is close to 40 mm. The electrode can be formed of any suitable material. One of such suitable material is nickel. Suitable dimensions for the electrodes 72 may be 0.1 mm in thickness, 2.5 mm in width and 40 mm in length. The length of the flat electrode 72 is important such that it extends substantially across the complete width of the lamp housing 60 to produce a substantially uniform electric discharge field in the cavity 78 formed between the lamp housing 62 and the cover plate 70. This is shown in FIG. 3D. A glass frit material 84 is used to bond the upper glass cover plate 70 to the side frames 64 of the lamp housing 60. The bonding enables a substantially vacuum tight cavity 78 to be formed inbetween the cover plate and the lamp housing. In operation, a radio frequency power of approximately 15 kHz is applied to the pair of flat electrodes 72 for generating a substantially uniform electric discharge in the cavity 78. A DC power between about 0.1 amp and about 10 amp (in relation to sample size) is normally utilized.

The pair of getter strips 74, or getter pieces are positioned in the cavity 78 juxtaposed to the flat electrodes 72 and the side frame 64. The pair of getter strips 74 can be supplied in a length of approximately 20 mm when the total width of the cavity is about 40 mm, as shown in FIG. 4. The getter strips 74 may be mounted in the cavity 78 by a pair of mounting supports 88 through the lamp housing 60. After the cover plate 70 and the lamp housing 60 are bonded together by the glass frit material 84, a vacuum can be withdrawn from the cavity 78 through an evacuation tube 90 provided through the side frame 64 of the lamp housing 60. After a suitable vacuum is achieved in the lamp cavity 78, and a mixture of insert gas is filled in the lamp cavity the evacuation tube 90 can be sealed off by fusing the glass tube 90.

The getter strip 74 can be suitably provided in a metal substrate of nickel and coated with a film of aluminum-zinc alloy on one surface, and a film of $Hg_xTi_y$ on the opposite surface. Once the getter strip is activated at a suitable temperature, i.e., at above 40° C. by a suitable heating means (not shown), the alloy film of aluminum-zinc absorbs by a chemical reaction gaseous impurities such as oxygen and nitrogen produced by the electrode plates and the various glass components inside the lamp 80. The use of the aluminum-zinc alloy prolongs the life of the planar fluorescent lamp. The film a $Hg_xTi_y$ alloy coated on the other side of the getter strip 70 produces a mercury vapor for filling the cavity 78 such that the brightness of light produced by the lamp 80 can be improved.

Figure 5:
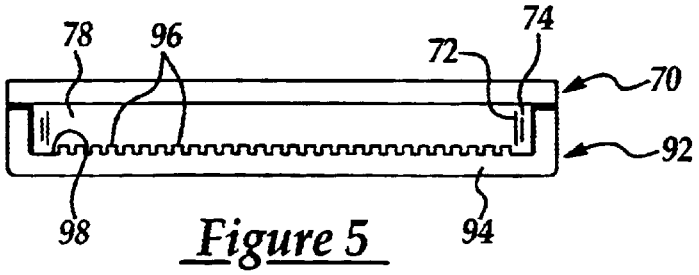
FIG. 5 is a cross-sectional view of an alternate embodiment of the present invention planar fluorescent lamp wherein the top surface of the planar bottom panel of the lamp housing is provided with a ribbed structure for improving the rigidity of the lamp housing.

An alternate embodiment of the lamp housing 92 is shown in FIG. 5 wherein the bottom panel 94 is provided with a ribbed structure 96 in a top surface 98. It should be noted that the rib structure 96 can be provided in any suitable dimensions as long as the rigidity of the bottom panel 94 can be improved. The improved rigidity of the bottom panel 94 prevents the panel from bowing in when the cavity 78 is withdrawn by vacuum. Instead of the rib structure 96 shown in FIG. 5, any other corrugated structure may also be used for improving the rigidity of the bottom panel 94. In the rib structure 96 shown, the ribs can be formed to a height of less than 0.7 mm when the total height of the cavity 78 is approximately 1.5 mm. The rib-to-rib distance may be suitably determined at between about 1 mm and about 10 mm, and preferably between about 4 mm and about 6mm.

Figure 6:
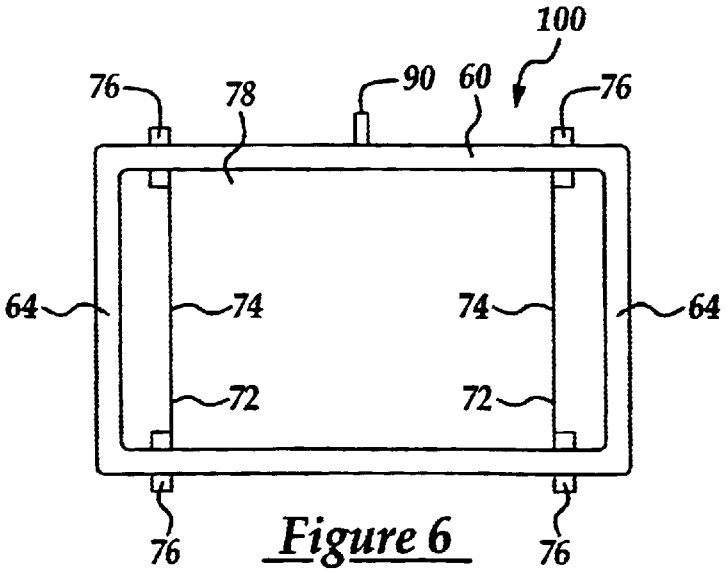
FIG. 6 is a plane view of another alternate embodiment of the present invention lamp wherein a pair of mercury dispensers or getter strips are formed unitarily with a pair of flat electrodes.

Another alternate embodiment of the lamp housing 100 is shown in FIG. 6. In this embodiment, the pair of mercury dispensers 74 or the pair of getter strips are formed unitary with the pair of flat electrodes 72. Separate getter strips and supports shown in FIG. 4 are therefore not needed in this construction.

Figure 7:
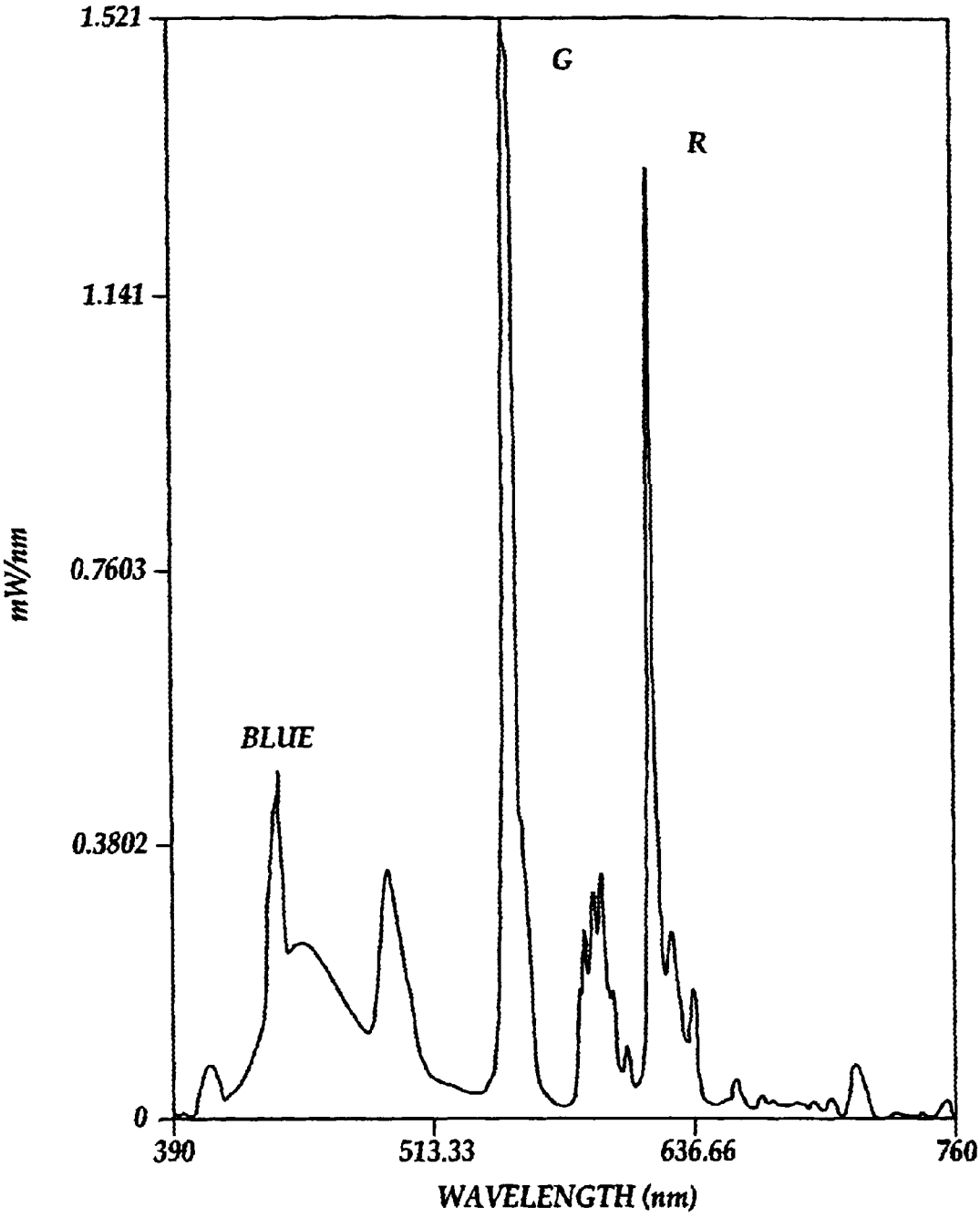
FIG. 7 is a spectrograph obtained on a present invention planar fluorescent lamp.

A spectrograph obtained on the present invention planar fluorescent lamp of FIG. 4 is shown in FIG. 7. It is seen that, with the tri-wavelength phosphor coated on the interior surfaces of the lamp housing, emissions of blue light, green light and red light are produced for forming a composite white light.

The present invention novel apparatus of a planar fluorescent lamp equipped with a pair of flat electrodes and a method for fabricating the lamp have been amply demonstrated in the above descriptions and in the appended drawings of FIGS. 3A~7.

While the present invention has been described in an illustrative manner, it should be understood that the terminology used is intended to be in a nature of words of description rather than of limitation.

Furthermore, while the present invention has been described in terms of a preferred and an alternate embodiment, it is to be appreciated that those skilled in the art will readily apply these teachings to other possible variations of the inventions.

The embodiment of the invention in which an exclusive property or privilege is claimed are defined as follows:

1. A planar fluorescent lamp equipped with flat electrodes comprising:

a lamp housing having a bottom panel and integrally formed side panels extending upwardly away from and along a peripheral edge of said bottom panel, said bottom panel having an inner surface of a corrugated structure formed linearly parallel to two of said opposing side panels, said side panels having a height substantially similar to a thickness of said planar fluorescent lamp, a cover plate having planar top and bottom surfaces each having a surface area substantially the same as the planar surface area of said bottom panel, said bottom surface of the cover plate being spaced-apart from said corrugated inner surface of said bottom panel sealingly engaging said side panels on said lamp housing forming a vacuum tight cavity therein, a fluorescent coating layer on a top surface of said planar bottom panel and said bottom surface of said cover plate, and a pair of flat electrodes each formed in an elongated rectangular shape and positioned in said vacuum tight cavity juxtaposed to one of two opposing side panels for forming a substantially uniform electric discharge field in said cavity.

2. A planar fluorescent lamp equipped with flat electrodes according to claim 1 further comprising a pair of mercury dispensers each positioned adjacent to one of said flat electrodes.

3. A planar fluorescent lamp equipped with flat electrodes according to claim 1 further comprising a pair of mercury dispensers in an elongated strip having $Hg_xTi_y$ coated thereon positioned in said vacuum tight cavity juxtaposed to said pair of flat electrodes.

4. A planar fluorescent lamp equipped with flat electrodes according to claim 1, wherein said lamp housing and said cover plate are formed of a ceramic material.

5. A planar fluorescent lamp equipped with flat electrodes according to claim 1, wherein said lamp housing and said cover plate are formed of glass.

6. A planar fluorescent lamp equipped with flat electrodes according to claim 5, wherein said bottom surface of the cover plate sealingly engaging said side panels on said lamp housing by bonding with a glass frit.

7. A planar fluorescent lamp equipped with flat electrodes according to claim 1, wherein said inner surface on said planar bottom panel being provided with a ribbed structure.

8. A planar fluorescent lamp equipped with flat electrodes according to claim 7, wherein said ribbed structure comprising a plurality of ribs each having a rib-to-rib distance between about 1 mm and about 10 mm, and a height of not more than 0.7 mm.

9. A planar fluorescent lamp equipped with flat electrodes according to claim 1, wherein said fluorescent coating layer formed on said top surface of said planar bottom panel and said bottom surface of said cover plate comprises phosphor.

10. A planar fluorescent lamp equipped with flat electrodes according to claim 2, wherein said pair of mercury dispensers are formed on a pair of getter pieces made of a metallic material.

11. A planar fluorescent lamp equipped with flat electrodes according to claim 10, wherein said getter pieces are formed of Ni having a film of Al—Zn alloy coated on one side and a film of $Hg_xTi_y$ coated on an opposite side.

12. A method for fabricating a planar fluorescent lamp equipped with a pair of flat electrodes comprising the steps of:

providing a lamp housing having a bottom panel and integrally formed side panels extending upwardly away from and along a peripheral edge of said bottom panel, said planar bottom panel having an inner surface of a corrugated structure formed linearly parallel to two of said opposing side panels, said side planar fluorescent lamp, providing a cover plate having planar top and bottom surfaces each having a surface area substantially the same as the planar surface area of said bottom panel, coating a fluorescent layer on a top surface of said planar bottom panel and said bottom surface of said cover plate, positioning a pair of flat electrodes each formed in an elongated rectangular shape in said lamp housing juxtaposed to one of two opposite side panels, and sealing engaging said bottom surface of the cover plate with said side panels on said lamp housing such that said bottom surface of the cover plate being spaced-apart from said corrugated inner surface of said bottom panel forming a substantially vacuum-tight cavity thereinbetween.

13. A method for fabricating a planar fluorescent lamp equipped with a pair of flat electrodes according to claim 12 further comprising the step of providing a pair of mercury dispensers in said substantially vacuum-tight cavity and positioning each of said pair between one of said flat electrodes and one of said side panels.

14. A method for fabricating a planar fluorescent lamp equipped with a pair of flat electrodes according to claim 12 further comprising the step of providing a pair of getter strips each formed of a metallic material and is coated with a film of Al—Zn alloy on one side and a film of $Hg_xTi_y$ on an opposite side.

15. A method for fabricating a planar fluorescent lamp equipped with a pair of flat electrodes according to claim 12 further comprising the step of forming said lamp housing and said cover plate in glass.

16. A method for fabricating a planar fluorescent lamp equipped with a pair of flat electrodes according to claim 12 further comprising the step of sealingly engaging said bottom surface of the cover plate with said side panels by bonding with a glass frit.

17. A method for fabricating a planar fluorescent lamp equipped with a pair of flat electrodes according to claim 12 further comprising the step of providing a lamp housing that has a top surface on said planar bottom panel fabricated in a corrugated structure.

18. A method for fabricating a planar fluorescent lamp equipped with a pair of flat electrodes according to claim 12 further comprising the step of providing a top surface on said planar bottom panel of the lamp housing in a ribbed structure.

19. A method for fabricating a planar fluorescent lamp equipped with a pair of flat electrodes according to claim 12 further comprising the step of coating said top surface of said planar bottom panel and said bottom surface of said cover plate with a coating material comprising phosphor.

20. A planar fluorescent lamp equipped with flat electrodes for illuminating liquid crystal display panels comprising:

a lamp housing having a bottom panel and integrally formed side panels extending upwardly away from and along a periphery of said bottom panel, said bottom panel having an inner surface of a corrugated structure formed linearly parallel to two of said opposing side panels, said side panels having a height of not more than 5 mm, a cover plate having parallel top and bottom surfaces and a surface area similar to a surface area on said bottom panel, said bottom surface of said cover plate being spaced-apart from said corrugated inner surface of said bottom panel sealingly engaging said side panels on said lamp housing forming a vacuum-tight cavity therein, a phosphor coating on said inner surface of said planar bottom panel and said bottom surface of said cover plate, a pair of flat electrodes each formed in an elongated rectangular shape and positioned in said cavity juxtaposed to one of two opposing side panels for forming a substantially uniform electric discharge field in said cavity, and a pair of getter strips each positioned between a flat electrode and an adjacent side panel for providing a mercury vapor in said cavity.

21. A planar fluorescent lamp equipped with flat electrodes for illuminating liquid crystal display panels according to claim 20, wherein said pair of getter strips each formed of Ni and coated with Al—Zn on one side and $Hg_xTi_y$ on the opposite side.

22. A planar fluorescent lamp equipped with flat electrodes for illuminating liquid crystal display panels according to claim 1 further comprising a pair of mercury dispensers formed unitary with said pair of flat electrodes.

* * * * *